US007275921B2

(12) United States Patent
Beaven

(10) Patent No.: US 7,275,921 B2
(45) Date of Patent: Oct. 2, 2007

(54) PUMPS

(75) Inventor: Robert William Beaven, Bristol (GB)

(73) Assignee: Automotive Motion Technology Ltd. (GB)

( * ) Notice: Subject to any disclaimer, the term of this patent is extended or adjusted under 35 U.S.C. 154(b) by 378 days.

(21) Appl. No.: 10/839,944

(22) Filed: May 6, 2004

(65) Prior Publication Data

US 2004/0228745 A1 Nov. 18, 2004

(30) Foreign Application Priority Data

May 8, 2003 (GB) ..... 0310518.6

(51) Int. Cl.
*F03C 2/00* (2006.01)
*F04C 18/00* (2006.01)

(52) U.S. Cl. ..... 418/196; 418/71; 418/78; 418/201.1; 418/206.1

(58) Field of Classification Search ..... 418/71, 418/78, 196, 197, 201.1, 206.1, 206.6
See application file for complete search history.

(56) References Cited

U.S. PATENT DOCUMENTS

| | | | | |
|---|---|---|---|---|
| 1,937,367 | A * | 11/1933 | Vickers | 418/196 |
| 2,588,888 | A | 3/1952 | Sennet | |
| 2,993,450 | A * | 7/1961 | Weigert | 418/71 |
| 3,086,474 | A | 4/1963 | Sennet | |
| 3,833,319 | A * | 9/1974 | Eglington | 418/132 |
| 3,927,869 | A | 12/1975 | Hanslik et al. | |
| 3,986,800 | A * | 10/1976 | Dworak et al. | 418/74 |

FOREIGN PATENT DOCUMENTS

| | | | |
|---|---|---|---|
| DE | 879208 | C | 7/1949 |
| GB | 471920 | | 9/1937 |
| JP | 59185886 | A | 10/1984 |
| JP | 04043884 | A | 2/1992 |
| JP | 07054870 | | 2/1995 |

OTHER PUBLICATIONS

United Kingdom Search Report issued in priority application GB 9310518.6.
English Language Abstract of Japanese Patent Application No. 07054870.
Search Report Issued by European Patent Office in European Patent Application No. 04 01 0908 (Mar. 23, 2005).

* cited by examiner

*Primary Examiner*—Theresa Trieu
(74) *Attorney, Agent, or Firm*—Dykema Gossett PLLC

(57) ABSTRACT

A pump e.g. a screw pump, includes a main pumping element and a generally parallel auxiliary pumping element, and a pump housing, the main and auxiliary pumping elements interacting with each other and with an internal wall of an elongate pumping chamber of the housing as they relatively rotate to pump fluid from a first axial inlet end of the elongate chamber towards a second axial outlet end of the elongate chamber, and wherein the internal wall of the elongate pumping chamber includes at least one recess which extends along at least a substantial portion of the axial extent of the chamber between the inlet and outlet ends of the chamber, an adjacent pumping element being contactable with the chamber wall at discrete contact edges either side of the recess.

15 Claims, 2 Drawing Sheets

PUMPS

This application claims priority to United Kingdom Patent Application No. GB0310518.6 filed May 8, 2003, the entire disclosure of which is incorporated herein by reference

FIELD OF THE INVENTION

This invention relates to a pump and more particularly to a pump which includes a pumping element which rotates in a housing.

DESCRIPTION OF THE PRIOR ART

An example of a pump of the kind with which the present invention is concerned is a screw pump which includes a main pumping element such as a driven or power screw, and one, or usually two auxiliary pumping elements or driven screws, the power and auxiliary screw or screws having screw forms which engage so that as the power screw is rotated, the auxiliary screw or screws rotate in the housing, the engaged screw forms and the housing providing pumping cavities to pump fluid from a low pressure pump end, to a high pressure pump end, as the power screw is rotated.

Particularly when pumping viscous fluids, particularly transmission oil at low temperature, there may be significant shear losses experienced between the screws and the housing. Although, these losses lessen as the oil warms up and becomes less viscous, during initial pump operation at least, when the oil is cool, such shear losses can contribute to a substantial power drain from a vehicle battery powering the pump. Vehicles with transmission oil pumps are expected to operate at environmental temperatures over a wide range e.g. between −40° C. and +125° C., and the viscosity of the transmission oil can vary substantially over that temperature range.

Unacceptable shear losses can also occur at high rotational speeds by which we mean pumping speeds in the order of 7,500 rpm.

SUMMARY OF THE INVENTION

According to one aspect of the invention we provide a pump including a main pumping element and a generally parallel auxiliary pumping element, and a pump housing, the main and auxiliary pumping elements interacting with each other and with an internal wall of an elongate pumping chamber of the housing as they relatively rotate to pump fluid from a first axial inlet end of the elongate chamber towards a second axial outlet end of the elongate chamber, and wherein the internal wall of the elongate pumping chamber includes at least one recess which extends along at least a substantial portion of the axial extent of the chamber between the inlet and outlet ends of the chamber, an adjacent pumping element being contactable with the chamber wall at discrete contact edges either side of the recess.

The provision of such a recess significantly reduces shear losses occurring between the chamber wall and the adjacent pumping element, especially where the fluid is viscous. Although the provision of such a recess may reduce the pumping efficiency of the pump by a small amount, the energy thus lost is significantly outweighed by the energy saved by the reduction of shear losses.

Because the pumping element may still contact the chamber wall at the discrete contact edges, tight interaction between the main and auxiliary pumping element or elements is maintained to keep leakage of fluid between them to a minimum.

Desirably, the recess extends generally axially of the pumping chamber but may wind around the axis of the adjacent pumping element if desired. In each case preferably the recess extends over substantially the entire axial extent of the pumping chamber.

The contact edges may extend along substantially the entire axial extent of the pumping chamber, or only along a portion thereof.

Desirably, a plurality of such recesses are provided which are generally parallel to one another, so that the discrete contact edges which are contactable by the adjacent pumping element, are provided between adjacent recesses. Thus the pumping chamber internal wall, may be provided by recesses separated by discrete contact edges either side of each such recess. Typically between three and five recesses are provided e.g. four recesses but more or less may be provided as required, in the internal wall for the or each of one or more of the pumping elements.

The or each recess preferably is of shallow depth, preferably of less than 1% of the outside diameter of the adjacent pumping element and possibly between 0.2% and 0.75% of the outside diameter of the adjacent pumping element.

Although the or each recess may have any desired cross section, preferably in cross section, the or each recess is generally arcuate.

The invention is particularly applicable where the main and auxiliary pumping elements are provided with interengaging screw forms which interact by meshing. Thus the pump may be a so called screw pump. Preferably a pair of auxiliary pumping elements are provided, one either side of the main pumping element. In one example, the main pumping element may be rotated in the pump housing by a prime mover such as an electric motor, to drive the auxiliary pumping element or elements, the meshing screw forms and the interaction between the auxiliary pumping element or elements and the internal wall or internal walls of the pumping chamber, creating pumping cavities for pumping the fluid from the inlet end to the outlet end of the pumping chamber.

Such a pump has particular application for pumping oil in an engine environment, such as transmission oil used for actuation systems on a vehicle.

According to a second aspect of the invention we provide a transmission including a pump according to the first aspect of the invention.

DESCRIPTION OF THE DRAWINGS

Embodiments of the invention will now be described with reference to the accompanying drawings in which:—

DESCRIPTION OF THE PREFERRED EMBODIMENTS OF THE INVENTION

Figure 1:
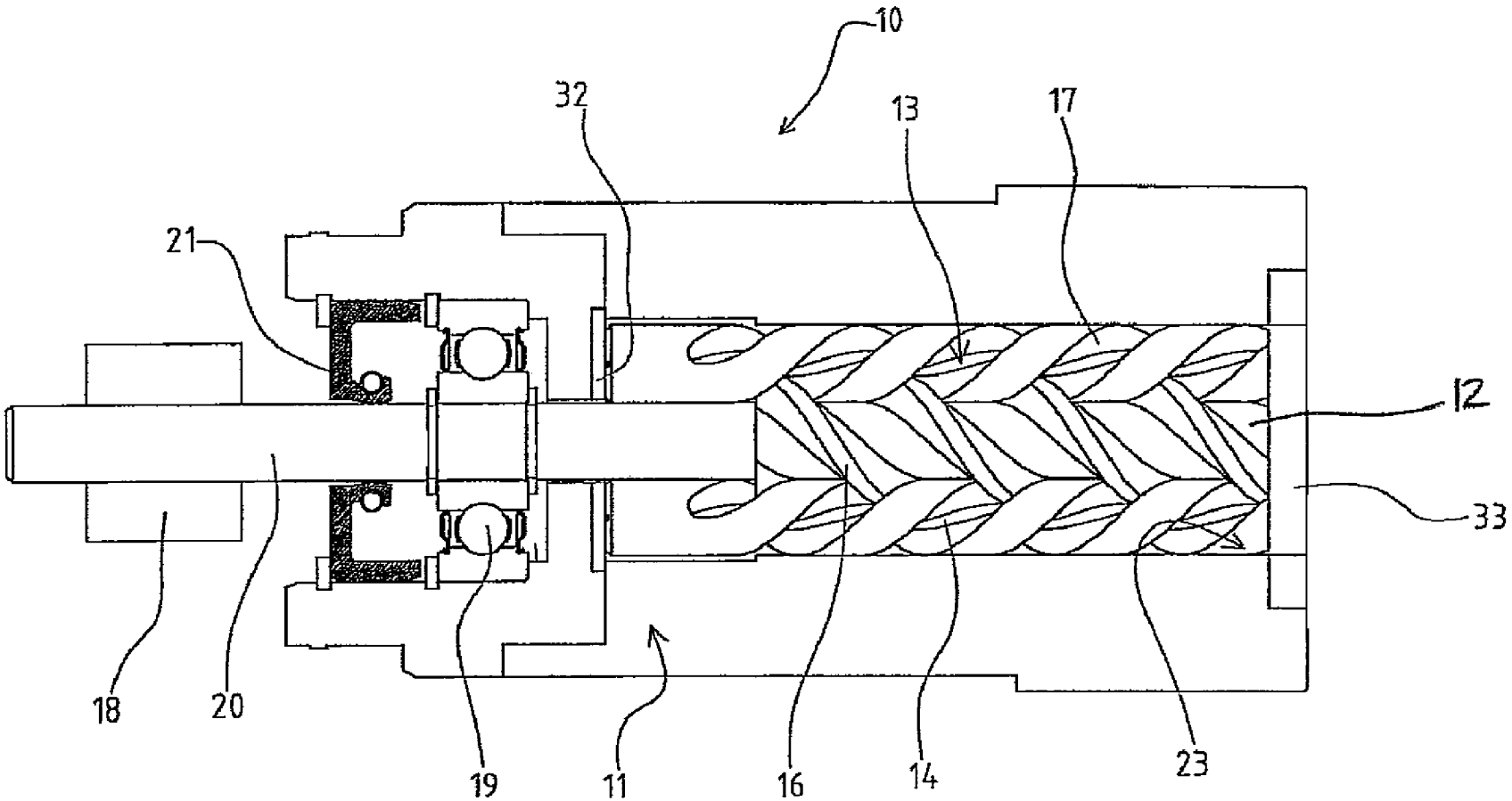
FIG. 1 is a illustrative side view of a pump in accordance with the invention.

Referring to the drawings, a screw pump 10 includes a housing 11 in which are provided a main pumping element 12, and first and second auxiliary pumping elements 13, 14.

In this example, there are two auxiliary pumping elements 13, 14 but in another example, only a single, or more than two auxiliary pumping elements 13, 14 may be provided.

The main pumping element 12 in this example, has an external screw form provided by a helical ridge 16, in indeed in the example shown, a pair of such helical ridges 16, which are interleaved with each other to provide a double start double screw thread form. Each of the auxiliary pumping elements 13, 14 also have a pair of screw forms 17 which mesh with the screw forms 16 of the main pumping element 12, so that as the main pumping element 12 is rotated in the housing 11 as described below, the auxiliary pumping elements 13, 14 are constrained to rotate in the housing 11.

In this example, the main pumping element 12 is a power or driven screw, and is secured to or is integral with a drive shaft 20 which is rotated by a prime mover such as an electric motor 18 which is only shown schematically in FIG. 1 of the drawings. The shaft 20 is journalled in bearing s 19 and a seal 21 is provided to isolate the pump 10 from the prime mover 18.

In another example though, the main pumping element 12 may be held secure whilst the housing 11, and the auxiliary pumping elements 13, 14 are rotated about the main pumping element 12, which again will constrain the auxiliary pumping elements 13, 14 to rotate in the housing 11.

In each case, the meshing screw forms 16, 17 of the main and auxiliary pumping elements 12, 13, 14 will interact with each other to form pumping cavities which progress axially of the pumping elements 12, 13, 14 to pump fluid from a low pressure axial end 32 of the pump 10 to a high pressure axial end 33 of the pump 10.

The housing 11 includes an elongate pumping chamber 23 in which the pumping elements 12, 13, 14 are contained, the pumping chamber 23 including a part circular main pumping element chamber part 24, and respective part circular auxiliary pumping element chamber parts 25, 26, each pumping chamber part 24, 25, 26 including a respective internal wall part 27, 28, 29 of an internal wall 30 of the pumping chamber 23, the configuration of which will be described below.

The pumping elements 12, 13, 14, as well as intermeshing, interact with their respective internal wall parts 27, 28, 29 as they rotate, and at least when the fluid being pumped is cool and viscous, this can result in substantial shear losses which are generally proportional to the cube of the nominal respective pumping chamber part 24, 25, 26 radius (or adjacent pumping element 12, 13, 14 external radius) times the square of the differential speed between the respective pumping element 12, 13, 14 and internal wall parts 27, 28, 29.

Where the pump 10 is for pumping transmission fluid, typically the pump 10 will be a high speed pump with the main pumping element 12, or the housing 11, being rotated at speeds of up to and greater than 7,500 rpm.

Figure 2:
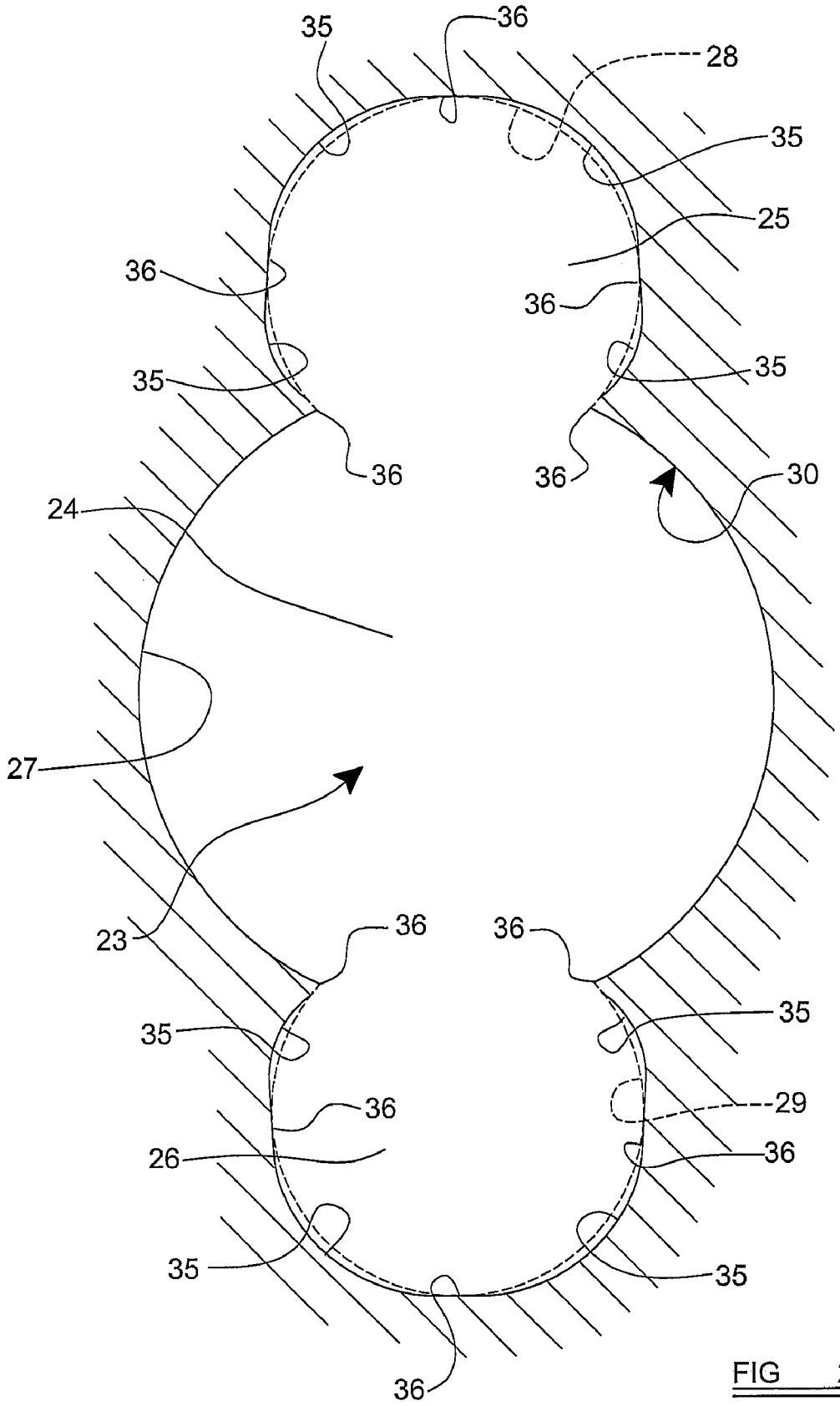
FIG. 2 is an enlarged cross section taken on the line 2-2 of FIG. 1, of the pumping chamber, excluding pumping elements for clarity.

Accordingly to reduce the shear losses, at least between the auxiliary pumping elements 13 and 14 and their respective internal wall parts 28, 29, the internal wall parts 28, 29 are provided with recesses 35, as best seen in FIG. 2.

The recesses 35 extend axially of the respective pumping chamber parts 25, 26 over substantially all, but at least a significant portion of the axial extents of the pumping chamber parts 25, 25 and in this example are straight, but could wind around the respective pumping chamber part 25, 25 axes as desired.

The recesses 35 may be of any desired cross section but preferably are arcuate, and shallow. In the example shown, the auxiliary pumping elements 13, 14 may each have an external diameter, and thus the internal wall parts 28, 29 have an internal diameter, of about 7 mm. The recesses 35 may have a depth of between 15 and 50 μm, or in the generality, a depth of between 0.2% and 0.75% of the external diameter of the adjacent pumping element 13, 14.

In the example shown there are four recesses 35 for each auxiliary element pumping chamber part 25, 26. However in another example, more or less such recesses 35 may be provided, for example between three and five recesses or perhaps up to as many as nine recesses.

In each case, the radii of the arcuate recesses 35 preferably are such that the whole internal wall part 28, 29 of the respective auxiliary pumping element pumping chamber part 25, 26 is provided by recesses 35 separated by discrete edges 36 which provide contact edges for the auxiliary pumping element 13, 14 rotating in the pumping chamber part 25, 26. When viewed in a transverse plane through the pumping chamber 23 as in FIG. 2, the contact edges 36 appear as points, but it should be appreciated that, in this example, the contact edges 36 extend along the entire axial extent of the pumping chamber parts 25, 26. Referring to FIG. 2, contact edges 36 are disposed on either side of recesses 35 such that a first discrete contact edge 36 may be between a pair of adjacent recesses 35 and second and third discrete contact edges 36 are on opposite sides of the recesses 35 relative to the first discrete contact edge 36.

In this way, shear losses between the auxiliary pumping elements 13, 14 and their respective pumping chamber 23 internal wall parts 28, 29, at least while the fluid being pumped is cool and viscous, are significantly reduced. As the pumped fluid warms to its usual operating temperature, in any event, such sheer losses may reduce. However the reduction of shear losses while the fluid is cool by virtue of the invention, and viscous can result in an important reduction of the drain on the vehicle battery powering the electric motor 18 when demand for power from the battery is likely to be highest, i.e. upon engine/vehicle start up.

Of course, the recesses 35 may reduce the pumping efficiency of the pump 10 slightly, but such reduction in efficiency will be offset by savings in efficiency achieved by reducing shear losses.

In a modified pump, the internal wall part 27 of the main pumping element pumping chamber part 24 may too or instead be provided with recesses to relieve shear losses otherwise occurring between the internal wall part 27 and the main pumping element 12, and again, the recesses may be separated by discrete contact edges for the rotating, or relatively rotating main pumping element 12 in the main pumping chamber part 24.

Various modifications may be made without departing from the scope of the invention. For example, in FIG. 1 of the drawing, at the pump inlet end 32, the pump inlet is provided by an axial inlet, and at the pump outlet end 33 the outlet is provided by an axial outlet. In other pumps, the inlets and outlets need not be axially located.

Moreover, whilst in the example shown, discrete contact edges 36 between adjacent recesses 35 extend along substantially the entire axial extent of the pumping chamber 23, the discrete contact edges 36 may extend along only a portion of the axial extent of the pumping chamber 23, further recesses being provided axially above and/or below the contact edges 36.

In this case, sufficient support for the pumping elements 12, 13, 14 would be provided as long as the axial length of each contact edge 36 exceeds the pitch of the screw forms 17 of the auxiliary pumping elements 13, 14.

Although the invention has been described in relation to a so called screw pump in which the main 12 and auxiliary pumping elements 13, 14 interact by meshing, the invention may be applied to other kinds of pump in which there are interacting pumping elements in a pumping chamber where shear losses can occur between one or more of the pumping elements and an adjacent internal pumping chamber wall.

In another example, the prime mover 18 for rotating the main pumping element 12 (or for rotating the housing 11 about the main pumping element 12) need not be electrically driven, although this is preferred.

I claim:

1. A pump including a main pumping element and a generally parallel auxiliary pumping element, and a pump housing, the main and auxiliary pumping elements interacting with each other and with an internal wall of an elongate pumping chamber of the housing as they relatively rotate to pump fluid from a first axial inlet end of the elongate chamber towards a second axial outlet end of the elongate chamber, and wherein the internal wall of the elongate pumping chamber includes first and second directly adjacent recesses which extend along at least a substantial portion of the axial extent of the chamber between the inlet and outlet ends of the chamber, an adjacent pumping element being contactable with the chamber wall at a first discrete contact edge between said first and second adjacent recesses and at second and third discrete contact edges on opposite sides of said first and second recesses, respectively, relative to said first discrete contact edge.

2. A pump according to claim 1 wherein the first recess extends generally axially of the pumping chamber.

3. A pump according to claim 1 wherein the first recess extends over substantially the entire axial extent of the pumping chamber.

4. A pump as claimed in claim 3 wherein the first, second and third discrete contact edges extend over substantially the entire axial extent of the pumping chamber.

5. A pump according to claim 3 wherein the first, second and third discrete contact edges extend over a portion of the axial extent of the pumping chamber.

6. A pump according to claim 1 wherein said first and second recesses are generally parallel to one another.

7. A pump according to claim 6 wherein between three and five recesses are provided in the internal wall, for the or each of one or more of the pumping elements.

8. A pump according to claim 1 wherein the first recess is of a depth of less than 1% of the outside diameter of the adjacent pumping element.

9. A pump according to claim 8 wherein the first recess is of a depth of between 0.2% and 0.75% of the outside diameter of the adjacent pumping element.

10. A pump according to claim 1 wherein the first recess in cross section, is generally arcuate.

11. A pump according to claim 1 wherein the main and auxiliary pumping elements are provided with interengaging screw forms which interact by meshing.

12. A pump according to claim 11 wherein a pair of auxiliary pumping elements are provided, one either side of the main pumping element.

13. A pump according to claim 11 wherein the main pumping element is rotatable in the pump housing by a prime mover to drive the auxiliary pumping element or elements, the meshing screw forms and the interaction between the auxiliary pumping element or elements and the internal wall or internal walls of the pumping chamber, creating pumping cavities for pumping the fluid from the inlet end to the outlet end of the pumping chamber.

14. A pump according to claim 1 wherein the pump is for pumping transmission oil in an engine environment.

15. A transmission including a main pumping element and a generally parallel auxiliary pumping element, and a pump housing, the main and auxiliary pumping elements interacting with each other and with an internal wall of an elongate pumping chamber of the housing as they relatively rotate to pump fluid from a first axial inlet end of the elongate chamber towards a second axial outlet end of the elongate chamber, and wherein the internal wall of the elongate pumping chamber includes first and second directly adjacent recesses which extend along at least a substantial portion of the axial extent of the chamber between the inlet and outlet ends of the chamber, an adjacent pumping element being contactable with the chamber wall at a first discrete contact edge between said first and second adjacent recesses and at second and third discrete contact edges on opposite sides of said first and second recesses, respectively, relative to said first discrete contact edge.

* * * * *